US010526899B2

(12) United States Patent
Zemitis et al.

(10) Patent No.: US 10,526,899 B2
(45) Date of Patent: Jan. 7, 2020

(54) TURBINE BLADE HAVING A TIP SHROUD

(71) Applicant: General Electric Company, Schenectady, NY (US)

(72) Inventors: William Scott Zemitis, Simpsonville, SC (US); Mahesh Pasupuleti, Karnataka (IN); Bryan David Lewis, Greenville, SC (US); Melbourne James Myers, Woodruff, SC (US)

(73) Assignee: General Electric Company, Schenectady, NY (US)

( * ) Notice: Subject to any disclaimer, the term of this patent is extended or adjusted under 35 U.S.C. 154(b) by 383 days.

(21) Appl. No.: 15/431,981

(22) Filed: Feb. 14, 2017

(65) Prior Publication Data

US 2018/0230821 A1 Aug. 16, 2018

(51) Int. Cl.

| | |
|---|---|
| ***F01D 5/22*** | (2006.01) |
| ***F01D 5/14*** | (2006.01) |
| ***F01D 5/20*** | (2006.01) |

(52) U.S. Cl.

CPC ..... *F01D 5/225* (2013.01); *F01D 5/147* (2013.01); *F01D 5/20* (2013.01); *F05D 2220/32* (2013.01); *F05D 2240/307* (2013.01)

(58) Field of Classification Search

CPC . F01D 5/225; F01D 5/20; F01D 5/141; F01D 5/147; F05D 2240/307

See application file for complete search history.

(56) References Cited

U.S. PATENT DOCUMENTS

| | | | | |
|---|---|---|---|---|
| 6,808,368 | B1 * | 10/2004 | Tomberg | F01D 5/14 416/223 A |
| 6,832,897 | B2 * | 12/2004 | Urban | F01D 5/225 416/223 A |
| 6,857,853 | B1 * | 2/2005 | Tomberg | F01D 5/147 415/914 |
| 7,001,152 | B2 | 2/2006 | Paquet et al. | |
| 7,063,509 | B2 | 6/2006 | Snook et al. | |
| 7,066,713 | B2 | 6/2006 | Dube et al. | |
| 7,396,205 | B2 * | 7/2008 | Dube | F01D 5/143 415/173.5 |
| 7,527,477 | B2 | 5/2009 | Norton et al. | |
| 7,762,779 | B2 * | 7/2010 | Zemitis | F01D 5/225 415/173.4 |
| 7,976,280 | B2 | 7/2011 | Brittingham et al. | |
| 8,322,986 | B2 | 12/2012 | Desander et al. | |
| 9,194,239 | B2 * | 11/2015 | Iida | F01D 5/225 |
| 9,322,281 | B2 | 4/2016 | Schlemmer et al. | |
| 9,683,446 | B2 * | 6/2017 | Shaffer | F01D 5/225 |
| 10,161,255 | B2 * | 12/2018 | Brozyna | F01D 9/041 |
| 2008/0019835 | A1 | 1/2008 | McFeat et al. | |
| 2012/0003078 | A1 | 1/2012 | Pikul et al. | |

(Continued)

FOREIGN PATENT DOCUMENTS

EP 1507064 B1 5/2016

*Primary Examiner* — Dwayne J White
*Assistant Examiner* — Jackson N Gillenwaters
(74) *Attorney, Agent, or Firm* — Armstrong Teasdale LLP

(57) ABSTRACT

A turbine blade includes an airfoil that extends from a root end to a tip end. A tip shroud extends from the tip end. The turbine blade further includes a pressure side fillet. The pressure side fillet couples the tip end to the tip shroud. The pressure side fillet includes a first protrusion located adjacent to the tip end and a second protrusion located radially inward from the first protrusion.

18 Claims, 6 Drawing Sheets

(56) References Cited

U.S. PATENT DOCUMENTS

| | | | | |
|---|---|---|---|---|
| 2012/0195766 | A1 | 8/2012 | Cohin et al. | |
| 2013/0251520 | A1* | 9/2013 | Barr | F01D 5/143 415/208.2 |
| 2014/0154079 | A1* | 6/2014 | Chouhan | F01D 5/143 416/179 |
| 2014/0154082 | A1 | 6/2014 | Shinn et al. | |
| 2015/0017003 | A1 | 1/2015 | Shaffer et al. | |
| 2015/0369058 | A1 | 12/2015 | Negri et al. | |
| 2016/0032733 | A1 | 2/2016 | Plante | |
| 2016/0115795 | A1 | 4/2016 | Munoz et al. | |
| 2017/0226864 | A1* | 8/2017 | Honkomp | F01D 5/143 |
| 2018/0016918 | A1 | 1/2018 | Skura et al. | |

* cited by examiner

TURBINE BLADE HAVING A TIP SHROUD

BACKGROUND

The field of the disclosure relates generally to rotary machines, and more particularly, to a turbine blade having a tip shroud.

At least some known rotary machines include a compressor, a combustor coupled downstream from the compressor, a turbine coupled downstream from the combustor, and a rotor shaft rotatably coupled between the compressor and the turbine. Some known turbines include at least one rotor disk coupled to the rotor shaft, and a plurality of circumferentially-spaced turbine blades that extend outward from each rotor disk to define a stage of the turbine. Each turbine blade includes an airfoil that extends radially outward from a platform towards a turbine casing.

At least some known turbine blades include a shroud that extends from an outer tip end of the airfoil to reduce gas flow leakage between the airfoil and the turbine casing. Additionally, at least some known tip shrouds are coupled to the airfoil tip end at an adjacent fillet region located at the intersection of the airfoil and the shroud. An operational life cycle of at least some turbine blades, such as but not limited to latter stage turbine blades, is limited by creep. Creep is the tendency of a material to deform over time when exposed to a combination of mechanical loading and high temperature. Turbine blade creep rate may be greatly impacted by peak stresses seen in the shroud and the fillet region, in combination with the high operating temperatures often seen at the shroud and the fillet region.

BRIEF DESCRIPTION

In one aspect, a turbine blade is provided. The turbine blade includes airfoil that extends from a root end to a tip end. A tip shroud extends from the tip end. The turbine blade further includes a pressure side fillet. The pressure side fillet couples the tip end to the tip shroud. The pressure side fillet includes a first protrusion located adjacent to the tip end, and a second protrusion located radially inward from the first protrusion.

In another aspect, a turbine blade is provided. The turbine blade includes an airfoil that extends from a root end to a tip end. A tip shroud extends from the tip end. The tip shroud includes a shroud plate that extends downstream from a leading edge, and extends circumferentially from a pressure side edge. The shroud plate includes at least one region having a locally reduced radial thickness along at least one of the pressure side edge and a pressure-side overhang portion of the leading edge.

In a further aspect, a turbine blade is provided. The turbine blade includes an airfoil that extends from a root end to a tip end. A tip shroud extends from the tip end. The tip shroud includes a shroud plate, a first shroud rail, and a second shroud rail. The second shroud rail is downstream from the first shroud rail. An outer surface of the shroud plate includes a shelf. The shelf extends axially between the first shroud rail and the second shroud rail, and extends circumferentially across a central portion of a circumferential width of the shroud plate.

DRAWINGS

DETAILED DESCRIPTION

The exemplary methods and systems described herein overcome at least some disadvantages of known turbine blades by providing a turbine blade that facilitates improving creep performance as compared to known turbine blades. More specifically, the embodiments described herein provide a turbine blade that is formed with a tip shroud. In some embodiments, an outer surface of the tip shroud plate includes a shelf of increased radial thickness. Additionally or alternatively, the tip shroud plate includes at least one region having a locally reduced radial thickness along at least one of a pressure side edge and a leading edge pressure-side overhang portion. Additionally or alternatively, a pressure-side fillet of the blade includes a first protrusion located adjacent to airfoil tip end, a second protrusion located radially inward from the first protrusion, and a diminution located between the first and second protrusions. The diminution is characterized by a diminished local, i.e., relative transverse thickness compared to the first and second protrusions. Each of these three features, alone or in combination, facilitates reducing mechanical stress concentrations in a first stress region located along the first rail, and/or in a second stress region located along an interface of the shroud plate inner surface and the pressure side fillet, thereby facilitating reduced creep strain in the blade.

Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Accordingly, a value modified by a term or terms such as "about," "approximately," and "substantially" is not to be limited to the precise value specified. In at least some instances, the approximating language may correspond to the precision of an instrument for measuring the value. Here and throughout the specification and claims, range limitations may be identified. Such ranges may be combined and/or interchanged, and include all the sub-ranges contained therein unless context or language indicates otherwise. Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item. As used herein, the term "upstream" refers to a forward or inlet end of a gas turbine engine, and the term "downstream" refers to an aft or nozzle end of the gas turbine engine.

Figure 1:
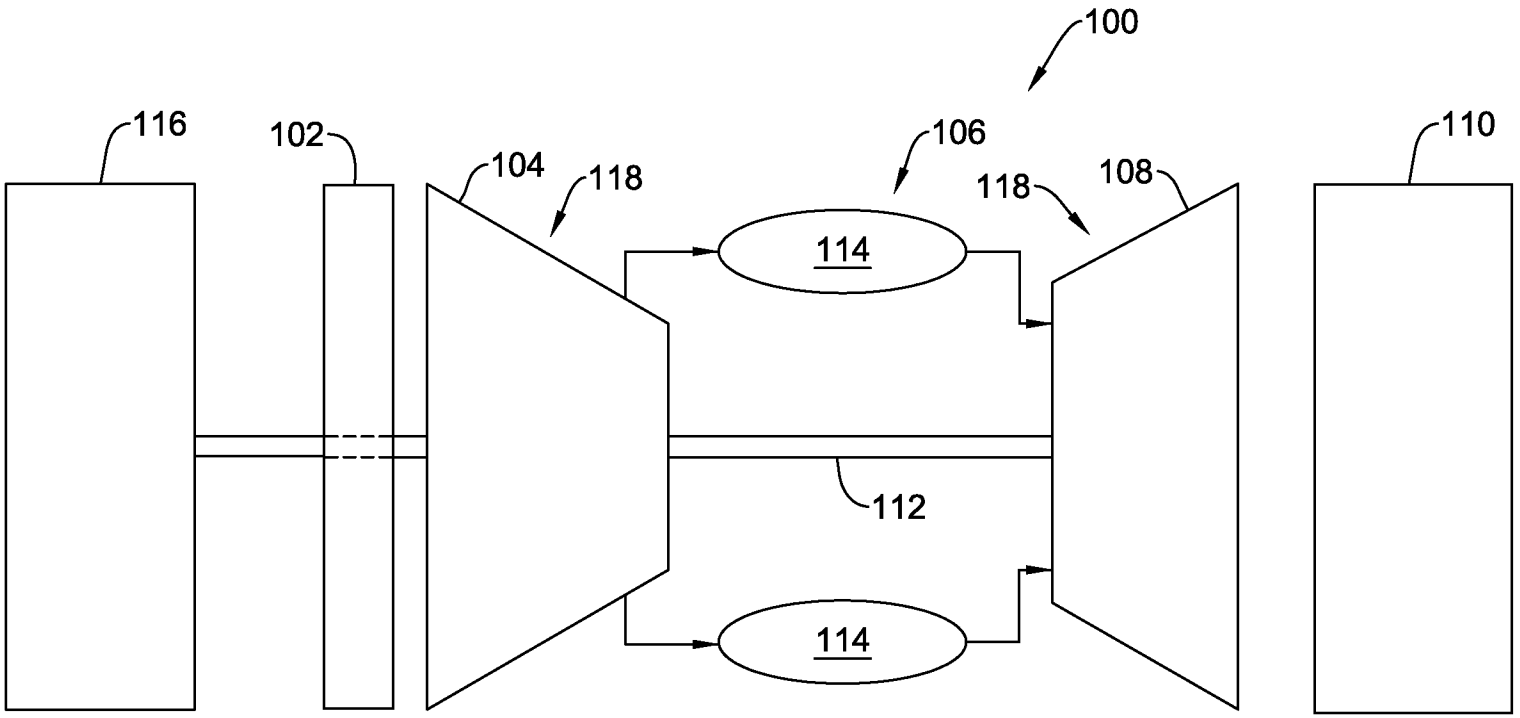
FIG. 1 is a schematic view of an exemplary rotary machine.

FIG. 1 is a schematic view of an exemplary rotary machine 100, i.e., a turbomachine, and more specifically a turbine engine. In the exemplary embodiment, turbine engine 100 is a gas turbine engine. Alternatively, turbine engine 100 may be any other turbine engine and/or rotary machine, including, without limitation, a steam turbine engine, a gas turbofan aircraft engine, other aircraft engine, a wind turbine, a compressor, and a pump. In the exemplary embodiment, turbine engine system 100 includes an intake section 102, a compressor section 104 that is coupled downstream from intake section 102, a combustor section 106 that is coupled downstream from compressor section 104, a turbine section 108 that is coupled downstream from combustor section 106, and an exhaust section 110 that is coupled downstream from turbine section 108. Turbine section 108 is coupled to compressor section 104 via a rotor shaft 112. In the exemplary embodiment, combustor section 106 includes a plurality of combustors 114. Combustor section 106 is coupled to compressor section 104 such that each combustor 114 is in flow communication with the compressor section 104. Turbine section 108 is further coupled to a load 116 such as, but not limited to, an electrical generator and/or a mechanical drive application. In the exemplary embodiment, each of compressor section 104 and turbine section 108 includes at least one rotor assembly 118 that is coupled to rotor shaft 112.

During operation, intake section 102 channels air towards compressor section 104. Compressor section 104 compresses air and discharges compressed air into combustor section 106 and towards turbine section 108 (shown in FIG. 1). The majority of air discharged from compressor section 104 is channeled towards combustor section 106. More specifically, pressurized compressed air is channeled to combustors 114 (shown in FIG. 1) wherein the air is mixed with fuel and ignited to generate high temperature combustion gases. The combustion gases are channeled towards a combustion gas path 232 (shown in FIG. 2), wherein the gases impinge upon turbine blades 204 (shown in FIG. 2) and stator vanes 202 (shown in FIG. 2) of turbine section 108 to facilitate imparting a rotational force on rotor assembly 118. At least a portion of the combustion gas that impinges upon turbine blades 204 is channeled between a tip shroud 236 (shown in FIG. 2) and turbine casing 210 (shown in FIG. 2).

Figure 2:
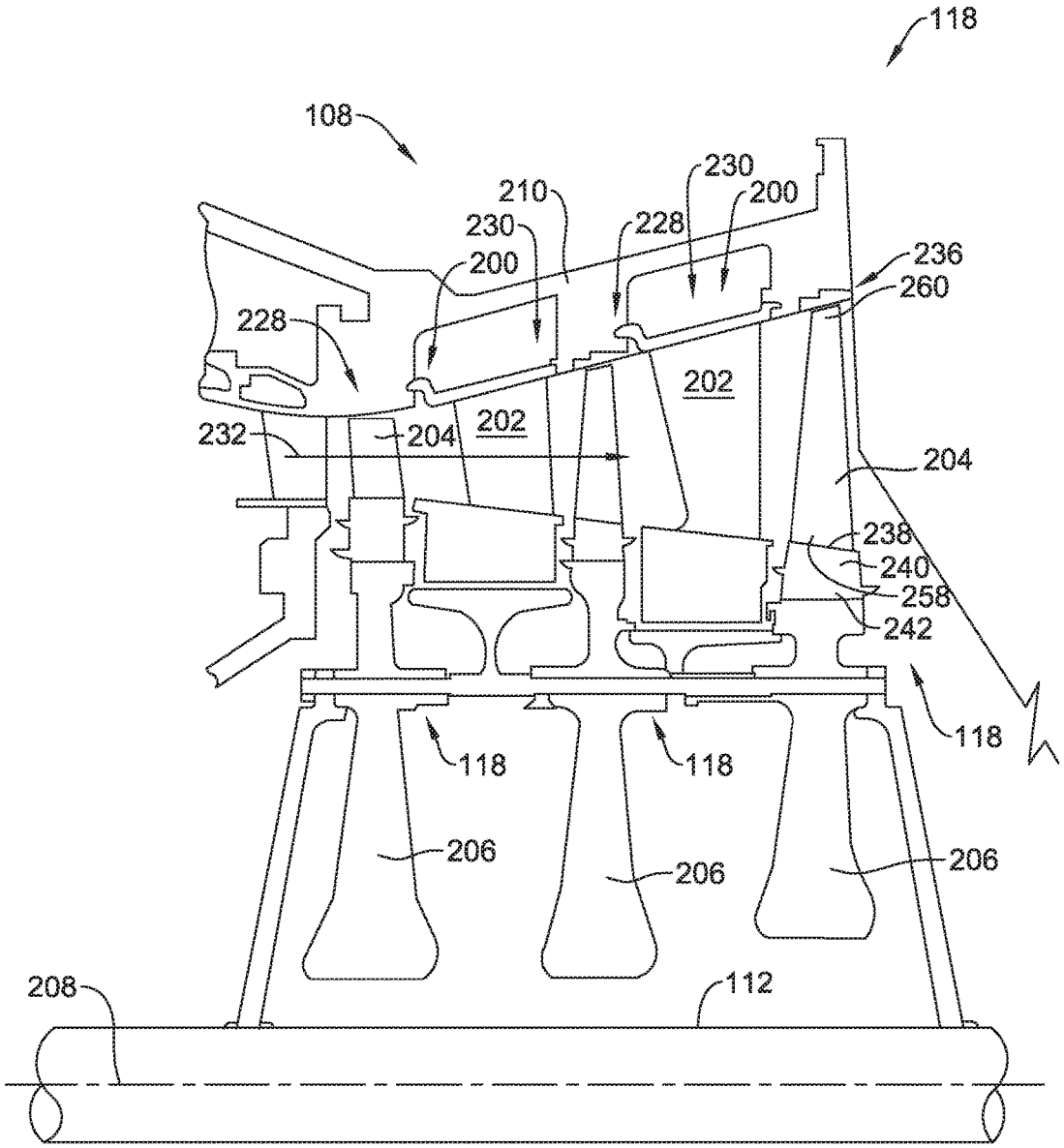
FIG. 2 is a partial sectional view of a portion of an exemplary rotor assembly that may be used with the exemplary rotary machine shown in FIG. 1.
Figure 3:
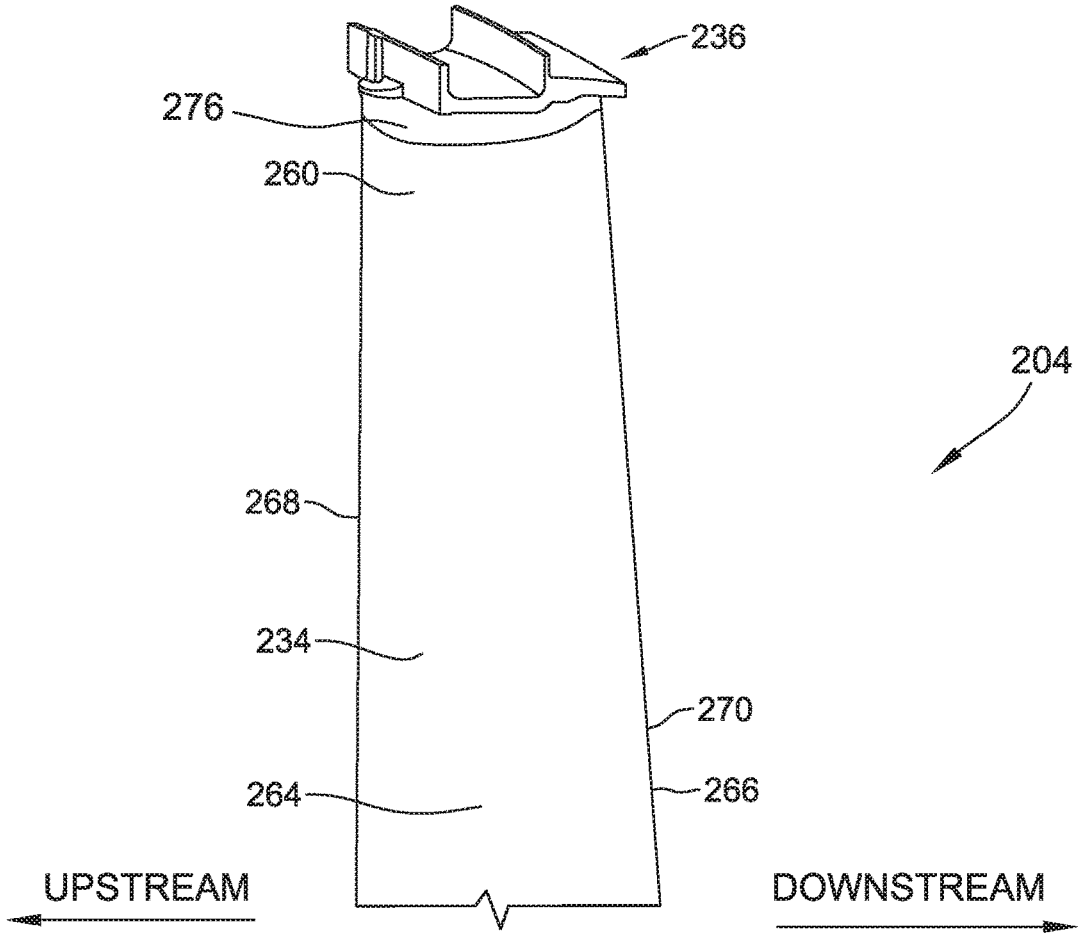
FIG. 3 is a perspective view of a pressure side of an exemplary turbine blade that may be used with the rotor assembly shown in FIG. 2.

FIG. 2 is a partial sectional view of a portion of an exemplary rotor assembly 118. FIG. 3 is a perspective view of a pressure side 264 of an exemplary turbine blade 204. In the exemplary embodiment, turbine section 108 includes a plurality of stages 200 that each include a stationary row 230 of stator vanes 202 and a corresponding row 228 of rotating turbine blades 204. Turbine blades 204 in each row 228 are spaced circumferentially about, and each extends radially outward from, a rotor disk 206. Each rotor disk 206 is coupled to rotor shaft 112 and rotates about a centerline axis 208 that is defined by rotor shaft 112. A turbine casing 210 extends circumferentially about rotor assembly 118 and stator vanes 202. Stator vanes 202 are each coupled to turbine casing 210 and each extends radially inward from casing 210 towards rotor shaft 112. A combustion gas path 232 is defined between turbine casing 210 and each rotor disk 206. Each row 228 and 230 of turbine blades 204 and stator vanes 202 extends at least partially through a portion of combustion gas path 232.

In the exemplary embodiment, each turbine blade 204 includes an airfoil 234, a tip shroud 236, a platform 238, a shank 240, and a dovetail 242. Airfoil 234 extends generally radially between platform 238 and tip shroud 236. Platform 238 extends between airfoil 234 and shank 240 and is oriented such that each airfoil 234 extends radially outwardly from platform 238 towards turbine casing 210. Shank 240 extends radially inwardly from platform 238 to dovetail 242. Dovetail 242 extends radially inwardly from shank 240 and enables turbine blades 204 to securely couple to rotor disk 206.

In the exemplary embodiment, airfoil 234 extends radially between a root end 258, adjacent to platform 238, and a tip end 260. Airfoil 234 extends radially outwardly from platform 238 such that tip end 260 is positioned adjacent to turbine casing 210. In the exemplary embodiment, airfoil 234 has a pressure side 264 and an opposite suction side 266. Each side 264 and 266 extends generally axially between a leading edge 268 and a trailing edge 270. Pressure side 264 is generally concave and suction side 266 is generally convex. In the exemplary embodiment, tip shroud 236 extends from tip end 260 of airfoil 234 and between tip end 260 and turbine casing 210. In the exemplary embodiment, pressure side fillet 276 is positioned adjacent to airfoil tip end 260 and is coupled to tip shroud 236.

Figure 4:
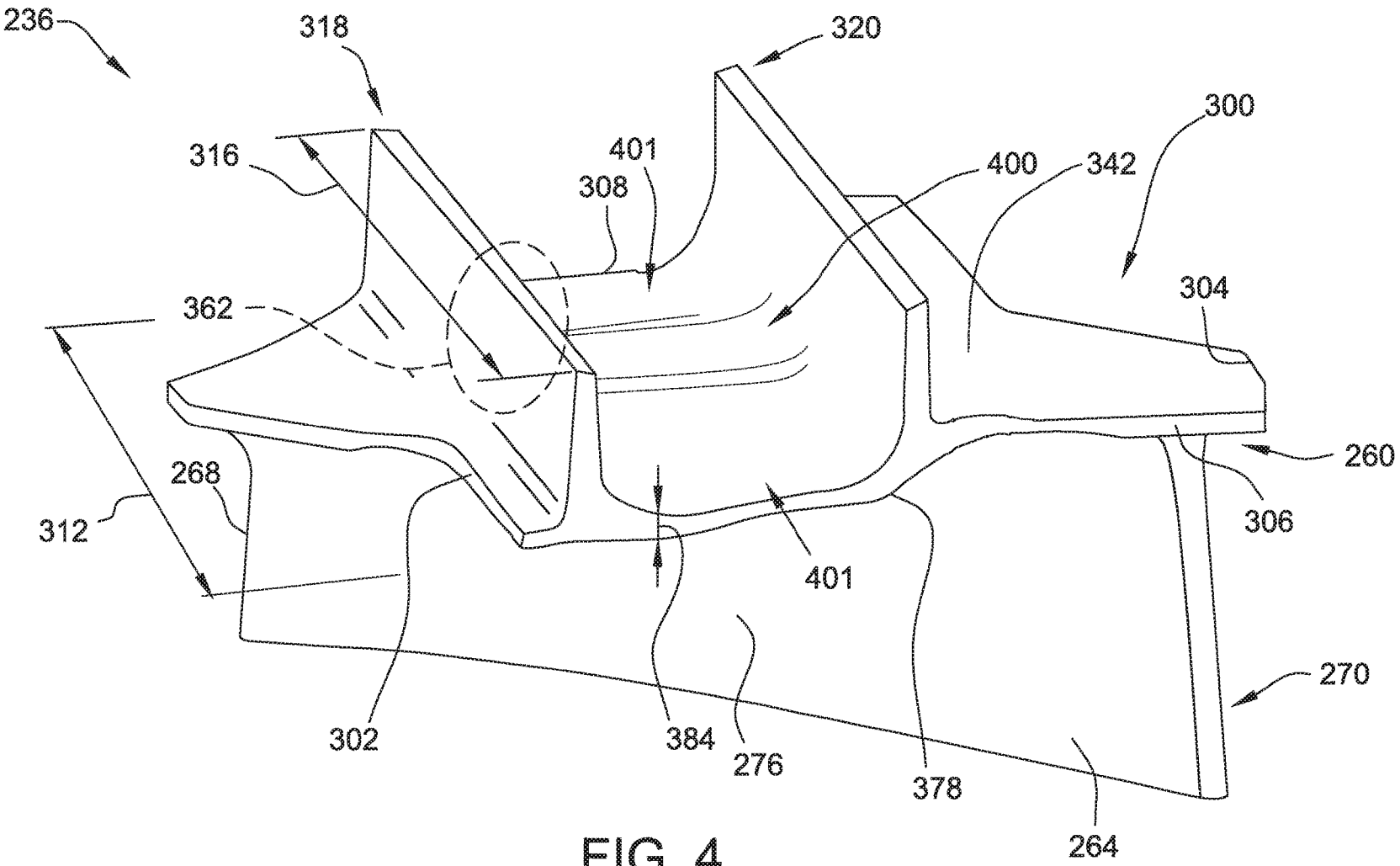
FIG. 4 is a perspective view of an exemplary tip shroud that may be used with the turbine blade shown in FIG. 3.
Figure 5:
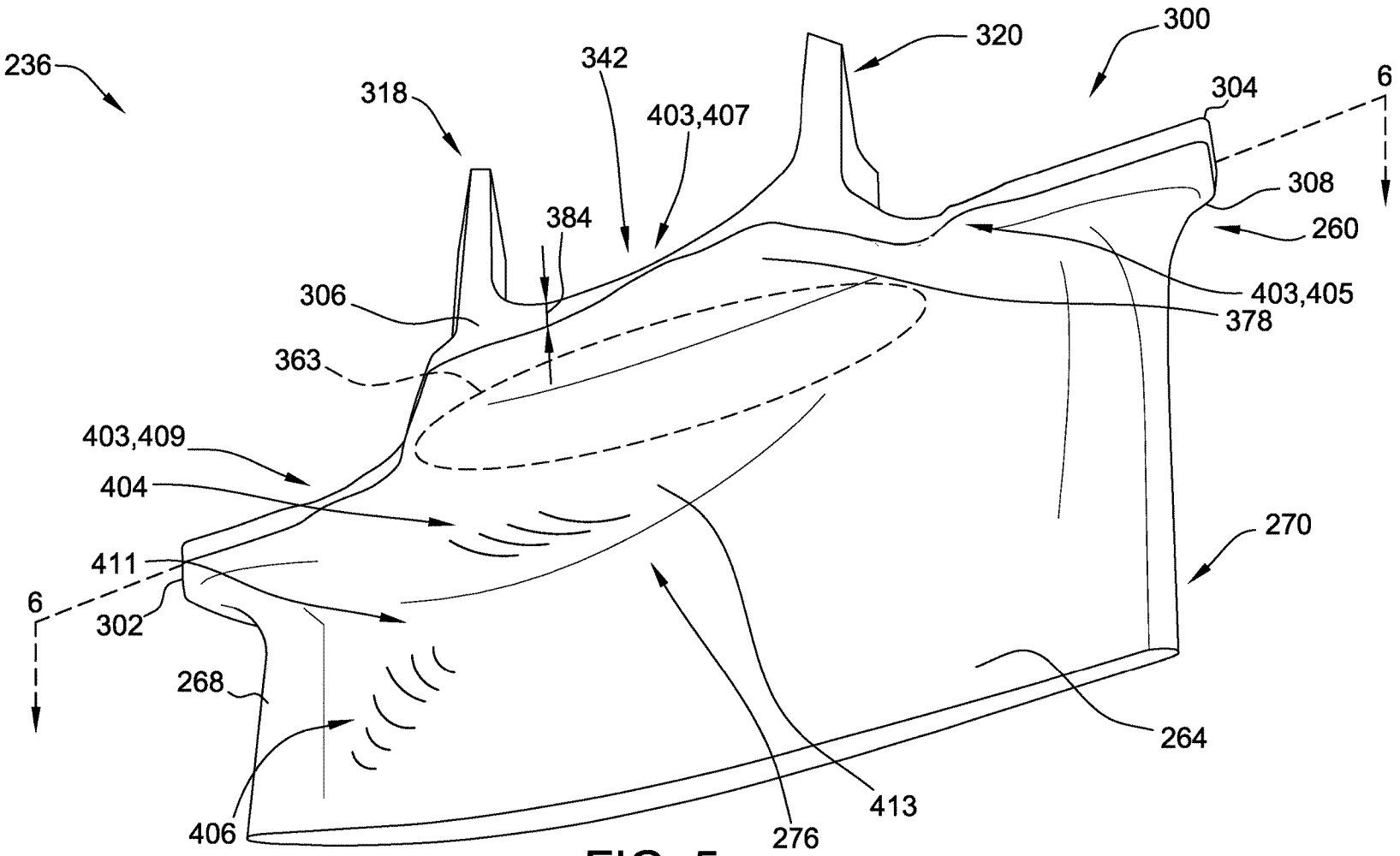
FIG. 5 is a perspective view of an exemplary pressure side fillet, and of the exemplary tip shroud shown in FIG. 4, of the exemplary turbine blade shown in FIG. 3.
Figure 6:
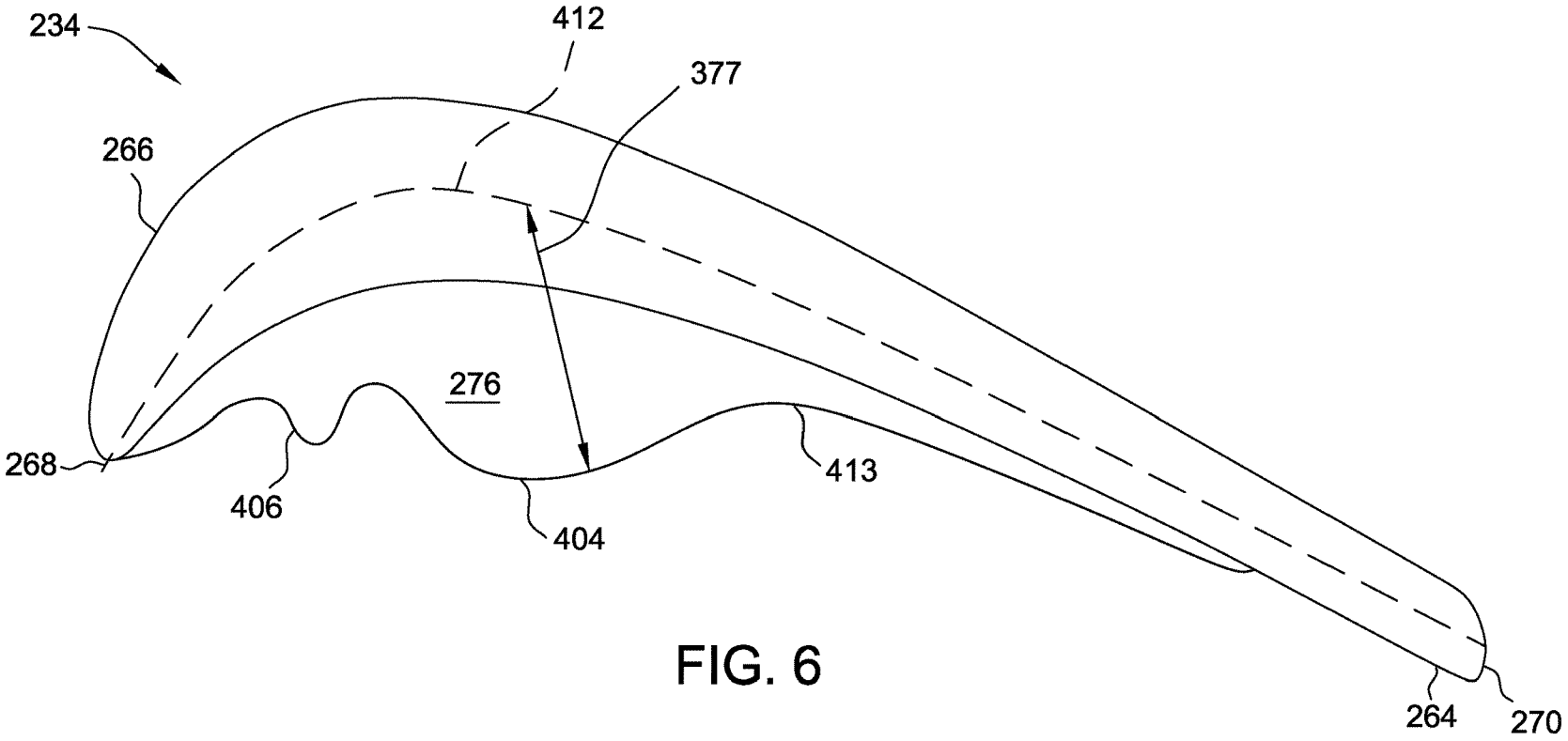
FIG. 6 is a cross-sectional view of the exemplary turbine blade shown in FIG. 3 including the exemplary pressure side fillet shown in FIG. 5.

FIG. 4 is a perspective view of an exemplary tip shroud 236 of turbine blade 204, FIG. 5 is a perspective view of an exemplary pressure side fillet 276 and exemplary tip shroud 236 shown in FIG. 4 of turbine blade 204, and FIG. 6 is a schematic cross-sectional view of turbine blade 204 including pressure side fillet 276 taken along lines 6-6 shown in FIG. 5.

In the exemplary embodiment, with reference to FIGS. 4-6, tip shroud 236 includes a shroud plate 300. Shroud plate 300 is generally rectangular and extends axially between a leading edge 302 and an opposite trailing edge 304, and circumferentially between a first, or pressure side edge 306 and an opposite second, or suction side edge 308. Shroud plate 300 extends radially between an inner surface 378 and an outer surface 342, and has a radial thickness 384 defined therebetween which may vary across shroud plate 300. In alternative embodiments shroud plate thickness 384 is substantially constant. In the exemplary embodiment, shroud plate 300 has a circumferential width 312 defined between side edges 306 and 308.

In the exemplary embodiment tip shroud 236 includes a first shroud rail 318 and second shroud rail 320 that each extend radially outward from shroud plate 300 towards turbine casing 210 (shown in FIG. 2). In alternative embodiments, tip shroud 236 includes any suitable number of shroud rails. In one embodiment, shroud rails 318 and 320 are formed separately from, and coupled to, shroud plate 300. In an alternative embodiment, shroud rails 318 and 320 are formed integrally with shroud plate 300. In the exemplary embodiment, each shroud rail 318 and 320 has a circumferential width 316 defined between plate side edges 306 and 308 that is approximately equal to plate circumferential width 312. In the exemplary embodiment, shroud rails 318 and 320 extend generally radially from shroud plate outer surface 342 and between shroud plate outer surface 342 and turbine casing 210.

In the exemplary embodiment, a first stress region 362 of blade 204 is defined on a portion of first shroud rail 318 that overhangs airfoil pressure side 264. In some embodiments, when blade 204 is in operation in rotary machine 100, a significant mechanical stress concentration occurs within first stress region 362. To the extent that a structure of tip shroud 236 and/or pressure side fillet 276 were to allow the mechanical stress concentration in first stress region 362 to surpass a threshold magnitude, a combination of a high temperature present at tip shroud 236 and the stress concentration in first stress region 362 would increase a fatigue on blade 204, and the resulting creep strain would reduce an operational life cycle of blade 204. In alternative embodiments, first stress region 362 is not defined on blade 204.

Also in the exemplary embodiment, a second stress region 363 is defined at an interface of shroud plate inner surface 378 and pressure side fillet 276. In some embodiments, when blade 204 is in operation in rotary machine 100, a significant mechanical stress concentration occurs within second stress region 363. To the extent that a structure of tip shroud 236 and/or pressure side fillet 276 were to allow the mechanical stress concentration in second stress region 363 to surpass a threshold magnitude, a combination of a high temperature present at tip shroud 236 and the stress concentration in second stress region 363 would increase a fatigue on blade 204, and resulting creep strain would reduce an operational life cycle of blade 204. In alternative embodiments, second stress region 363 is not defined on blade 204.

In the exemplary embodiment, shroud plate outer surface 342 includes a shelf 400 that extends axially between shroud rails 318 and 320, and circumferentially across a central portion of circumferential width 312. Shelf 400 is defined by a discontinuous increase in radial thickness 384 from non-shelf regions 401 to shelf 400. In the exemplary embodiment, shelf 400 extends axially from first rail 318 to rail 320. In alternative embodiments, shelf 400 extends only over a portion of an axial distance between rail 318 and rail 320. In some such embodiments, it has been determined that shelf 400 facilitates reducing a mechanical stress concentration in each of stress regions 362 and 363, as compared to at least some known tip shrouds, thereby facilitating a reduction in fatigue and creep strain of blade 204, while maintaining an acceptable structural performance of blade 204. For example, in the exemplary embodiment, shelf 400 extends across about a central one-third of circumferential width 312, which has been determined to produce a particular benefit as described above. However, embodiments in which shelf 400 extends across a central portion of circumferential width 312 that is greater or less than one-third of circumferential width 312 also produce a substantial benefit.

In certain embodiments, shroud plate 300 includes at least one region 403 of locally reduced radial thickness 384 along at least one of pressure side edge 306 and a pressure-side overhang portion of leading edge 302. For example, in the exemplary embodiment, the at least one region 403 includes a first region 405 of locally reduced radial thickness 384 along pressure side edge 306 between second rail 320 and trailing edge 304. For another example, in the exemplary embodiment, the at least one region 403 includes a second region 407 of locally reduced radial thickness 384 along pressure side edge 306 between rails 318 and 320. For another example, in the exemplary embodiment, the at least one region 403 includes a third region 409 of locally reduced radial thickness 384 located along the pressure side overhang portion of leading edge 302.

In some such embodiments, it has been determined that including at least one region 403 of locally reduced radial thickness 384 along at least one of pressure side edge 306 and a pressure-side overhang portion of leading edge 302 of shroud plate 300 reduces a mechanical stress concentration in stress regions 362 and 363, as compared to at least some known tip shrouds, thereby facilitating a reduction in fatigue and creep strain of blade 204, while maintaining an acceptable structural performance of blade 204. In particular, it has been determined that including all of regions 405, 407, and 409 having a locally reduced radial thickness 384 provides a particular advantage as compared to at least some known tip shrouds. In addition, in certain embodiments, inclusion of at least two of regions 405, 407, and 409 having a reduced radial thickness 384 produces enhanced reduction of the mechanical stress concentration in each stress region 362 and 363, as compared to including solely one region 405, 407, or 409 having a locally reduced radial thickness 384. However, in certain embodiments, inclusion of solely one of regions 405, 407, and 409 having a locally reduced radial thickness 384 produces benefits over at least some known tip shrouds.

In certain embodiments, pressure side fillet 276 includes a first protrusion 404 and a second protrusion 406. More specifically, first protrusion 404 is located adjacent to airfoil tip end 260, and second protrusion 406 is located radially inward from first protrusion 404. Protrusions 404 and 406 are each defined by local regions of fillet material protruding outwardly with respect to a curvature of adjacent portions of pressure side fillet 276, resulting in a corresponding local increase in a transverse thickness 377 relative to adjacent portions of pressure side fillet 276. As shown in FIG. 6, local transverse thickness 377 is measured, parallel to the circumferential direction, from a cross-sectional centerline 412 of airfoil 234 to a surface 413 of pressure side fillet 276. It should be understood that FIG. 6 is a schematic illustration, and protrusions 404 and 406 are not necessarily drawn to scale.

In the exemplary embodiment, protrusions 404 and 406 are separated by a diminution 411 therebetween. Diminution 411 is characterized by a diminished local, i.e., relative transverse thickness 377 as compared to protrusions 404 and 406. In other words, diminution 411 is defined relative to protrusions 404 and 406, and does not necessarily have a diminished local transverse thickness 377 relative to other portions of pressure side fillet 276.

In some embodiments, it has been determined that including protrusions 404 and 406 on pressure side fillet 276 facilitates a reduction in a mechanical stress concentration in each stress region 362 and 363, as compared to at least some known turbine blades, thereby facilitating reduced fatigue and creep strain of blade 204, while maintaining an acceptable structural performance of blade 204.

For example, in some embodiments, protrusion 404 extends axially downstream from an upstream end generally adjacent, with respect to the axial direction, to rail 318. Additionally or alternatively, protrusion 404 extends generally downward in a direction away from shroud plate inner surface 378. In the exemplary embodiment, the downstream end of protrusion 404 is positioned between rails 318 and 320. In alternative embodiments, protrusion 404 extends downstream to any suitable extent. Additionally or alternatively, protrusion 406 is positioned at least partially upstream relative to protrusion 404. Additionally or alternatively, protrusion 406 extends generally downward in a direction away from shroud plate inner surface 378. It has been determined that including protrusions 404 and 406, as described in each of these embodiments, provides a particular advantage as compared to at least some known pressure side fillets. However, other specific arrangements of first protrusion 404 adjacent to airfoil tip end 260 and second protrusion 406 defined radially inward of first protrusion 404 also provide substantial benefits as compared to known turbine blades.

In addition, in certain embodiments, inclusion on blade 204 of at least two of (i) shelf 400 on shroud plate outer surface 342, (ii) the at least one region 403 of locally reduced radial thickness 384 along at least one of pressure side edge 306 and the pressure-side overhang portion of leading edge 302, and (iii) first protrusion 404 and second protrusion 406 on pressure side fillet 276 facilitate an enhanced reduction of a mechanical stress concentration in each of stress regions 362 and 363, as compared to inclusion of solely one of these three features. Moreover, in certain embodiments, inclusion on blade 204 of all three of these features enhances reduction of a mechanical stress concentration in each of regions 362 and 363, as compared to including just one or two of these three features. Nevertheless, substantial benefits are still obtainable by including solely one of these three features on blade 204.

The above-described embodiments of turbine blades overcome at least some disadvantages of known turbine blades by providing a turbine blade that facilitates improving creep performance as compared to known turbine blades. More specifically, the embodiments described herein provide a turbine blade that is formed with a tip shroud. In some embodiments, an outer surface of a tip shroud plate includes a shelf that extends axially between first and second shroud rails, and circumferentially across a central portion of a circumferential width of the shroud plate. Additionally or alternatively, the tip shroud plate includes at least one region having a locally reduced radial thickness along at least one of a pressure side edge and a leading edge pressure-side overhang portion. Additionally or alternatively, a pressure-side fillet of the blade includes a first protrusion located adjacent to the airfoil tip end and a second protrusion located radially inward from the first protrusion. Each of these three features, alone or in combination, facilitate reducing creep strain in the blade by reducing mechanical stress concentrations in a first stress region located along the first rail and/or a second stress region located along an interface of the shroud plate inner surface and the pressure side fillet, while maintaining an acceptable structural performance of the blade.

Exemplary embodiments of a turbine blade are described above in detail. The apparatus is not limited to the specific embodiments described herein, but rather, elements of the blade may be utilized independently and separately from other elements described herein. For example, elements of the apparatus may also be used in combination with other blades for other rotary machines, and are not limited to practice with only the blade and gas turbine engine assembly as described herein. Rather, the exemplary embodiment may be implemented and utilized in connection with many other rotary machine applications.

Although specific features of various embodiments may be shown in some drawings and not in others, this is for convenience only. Moreover, references to "one embodiment" in the above description are not intended to be interpreted as excluding the existence of additional embodiments that also incorporate the recited features. In accordance with the principles of the disclosure, any feature of a drawing may be referenced and/or claimed in combination with any feature of any other drawing.

This written description uses examples, including the best mode, and to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine blade comprising:

an airfoil that extends from a root end to a tip end;

a tip shroud extending from said tip end; and a pressure side fillet coupling said tip end to said tip shroud, said pressure side fillet comprising a first protrusion located adjacent to said tip end and a second protrusion located radially inward from said first protrusion.

2. The turbine blade in accordance with claim 1, wherein said tip shroud comprises a first shroud rail, said first protrusion extends axially from an upstream end generally adjacent said first shroud rail to a downstream end.

3. The turbine blade in accordance with claim 2, wherein said tip shroud further comprises a second shroud rail downstream from said first shroud rail, said downstream end of said first protrusion is located between said first shroud rail and second shroud rail.

4. The turbine blade in accordance with claim 1, wherein said second protrusion is located at least partially upstream relative to said first protrusion.

5. The turbine blade in accordance with claim 1, wherein said tip shroud comprises a shroud plate that extends downstream from a leading edge and extends circumferentially from a pressure side edge, said shroud plate comprises at least one region of locally reduced radial thickness along at least one of said pressure side edge and a pressure-side overhang portion of said leading edge.

6. The turbine blade in accordance with claim 5, wherein said tip shroud further comprises a first shroud rail and a second shroud rail downstream from said first shroud rail, said at least one region comprises at least one of (i) a first region of locally reduced radial thickness along said pressure side edge between said second shroud rail and a trailing edge of said shroud plate, (ii) a second region of locally reduced radial thickness along said pressure side edge between said first shroud rail and said second shroud rail, and (iii) a third region of locally reduced radial thickness along said pressure-side overhang portion of said leading edge.

7. The turbine blade in accordance with claim 1, wherein said tip shroud further comprises a shroud plate, a first shroud rail, and a second shroud rail downstream from said first shroud rail, and wherein an outer surface of said shroud plate comprises a shelf that extends axially between said first shroud rail and said second shroud rail, and circumferentially across a central portion of a circumferential width of said shroud plate.

8. A turbine blade comprising:

an airfoil that extends from a root end to a tip end; and a tip shroud extending from said tip end, said tip shroud comprises a shroud plate, a first shroud rail, and a second shroud rail downstream from said first shroud rail, said shroud plate extends downstream from a leading edge and extends circumferentially from a pressure side edge, said shroud plate comprises at least one region of locally reduced radial thickness along at least one of said pressure side edge and a pressure-side overhang portion of said leading edge, wherein said at least one region comprises a first region of locally reduced radial thickness along said pressure side edge between said second shroud rail and a trailing edge of said shroud plate.

9. The turbine blade in accordance with claim 8, wherein said at least one region further comprises at least one of (i) a second region of locally reduced radial thickness along said pressure side edge between said first shroud rail and said second shroud rail, and (ii) a third region of locally reduced radial thickness along said pressure-side overhang portion of said leading edge.

10. The turbine blade in accordance with claim 8, wherein said at least one region further comprises each of (i) a second region of locally reduced radial thickness along said pressure side edge between said first shroud rail and said second shroud rail, and (ii) a third region of locally reduced radial thickness along said pressure-side overhang portion of said leading edge.

11. The turbine blade in accordance with claim 8, further comprising a pressure side fillet coupling said tip end to said tip shroud, said pressure side fillet comprising a first protrusion located adjacent to said tip end and a second protrusion located radially inward of said first protrusion.

12. The turbine blade in accordance with claim 11, wherein said first protrusion extends axially from an upstream end generally adjacent said first shroud rail to a downstream end.

13. The turbine blade in accordance with claim 11, wherein said second protrusion is located at least partially upstream relative to said first protrusion.

14. The turbine blade in accordance with claim 11, wherein an outer surface of said shroud plate comprises a shelf that extends axially between said first shroud rail and said second shroud rail, and circumferentially across a central portion of a circumferential width of said shroud plate.

15. A turbine blade comprising:

an airfoil that extends from a root end to a tip end;

a tip shroud extending from said tip end, said tip shroud comprises a shroud plate, a first shroud rail, and a second shroud rail downstream from said first shroud rail, wherein an outer surface of said shroud plate comprises a shelf that extends axially between said first shroud rail and said second shroud rail, and extends circumferentially across a central portion of a circumferential width of said shroud plate; and a pressure side fillet coupling said tip end to said tip shroud, said pressure side fillet comprising a first protrusion located adjacent to said tip end and a second protrusion located radially inward of said first protrusion.

16. The turbine blade in accordance with claim 15, wherein said shelf extends across about a central one-third of said circumferential width.

17. The turbine blade in accordance with claim 15, wherein said shroud plate extends downstream from a leading edge and extends circumferentially from a pressure side edge, said shroud plate further comprises at least one region of locally reduced radial thickness along at least one of said pressure side edge and a pressure-side overhang portion of said leading edge.

18. The turbine blade in accordance with claim 17, wherein said at least one region comprises at least one of (i) a first region of locally reduced radial thickness along said pressure side edge between said second shroud rail and a trailing edge of said shroud plate, (ii) a second region of locally reduced radial thickness along said pressure side edge between said first shroud rail and said second shroud rail, and (iii) a third region of locally reduced radial thickness along said pressure-side overhang portion of said leading edge.

* * * * *